US006653755B2

(12) United States Patent
Machiroutu

(10) Patent No.: US 6,653,755 B2
(45) Date of Patent: Nov. 25, 2003

(54) RADIAL AIR FLOW FAN ASSEMBLY HAVING STATOR FINS SURROUNDING ROTOR BLADES

(75) Inventor: Sridhar V. Machiroutu, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/871,413

(22) Filed: May 30, 2001

(65) Prior Publication Data

US 2002/0180285 A1 Dec. 5, 2002

(51) Int. Cl.[7] ..... H02K 1/32; H02K 3/24; H02K 5/18; H02K 5/20; H02K 9/00

(52) U.S. Cl. ..... 310/64; 310/67 R; 310/66; 310/58; 310/40 R

(58) Field of Search ..... 310/67 R, 66, 310/64, 58, 40 R, 10

(56) References Cited

U.S. PATENT DOCUMENTS 1,564,896 A * 12/1925 Rinker et al. ..... 392/385
3,426,441 A * 2/1969 Broski ..... 34/553
3,700,358 A * 10/1972 Papst et al. ..... 417/354
4,135,080 A * 1/1979 Wells, Jr. ..... 392/385
4,232,454 A * 11/1980 Springer ..... 34/97
5,026,251 A * 6/1991 Kinoshita et al. ..... 415/119
5,311,089 A * 5/1994 Stroetgen et al. ..... 310/50
5,632,578 A * 5/1997 McCurry et al. ..... 409/136
5,675,206 A * 10/1997 Horski ..... 310/268
5,727,624 A * 3/1998 Ko et al. ..... 165/121
5,771,961 A * 6/1998 Alizadeh ..... 165/121
5,875,562 A * 3/1999 Fogarty ..... 34/97
6,111,748 A * 8/2000 Bhatia ..... 361/695
6,152,214 A * 11/2000 Wagner ..... 165/121
6,157,104 A * 12/2000 Yokozawa et al. ..... 310/58
6,185,097 B1 * 2/2001 Behl ..... 361/695
6,222,731 B1 * 4/2001 Katsui ..... 361/697
6,252,770 B1 * 6/2001 Yu et al. ..... 361/695
6,265,797 B1 * 7/2001 Horng ..... 310/90
6,272,011 B1 * 8/2001 Chen ..... 361/685
6,348,748 B1 * 2/2002 Yamamoto ..... 310/62
6,400,053 B1 * 6/2002 Horng ..... 310/91
6,406,274 B1 * 6/2002 Lin et al. ..... 417/354
6,421,239 B1 * 7/2002 Huang ..... 361/696
6,438,984 B1 * 8/2002 Novotny et al. ..... 62/259.2
6,442,025 B2 * 8/2002 Nakamura et al. ..... 361/695
6,472,782 B1 * 10/2002 Selci ..... 310/63
6,477,045 B1 * 11/2002 Wang ..... 361/700
6,487,076 B1 * 11/2002 Wang ..... 361/697
6,488,472 B1 * 12/2002 Miyazawa ..... 416/144
6,496,118 B1 * 12/2002 Smith ..... 340/584
6,496,368 B2 * 12/2002 Jui-Yuan ..... 361/697
6,498,395 B2 * 12/2002 Baek et al. ..... 257/722
6,501,652 B2 * 12/2002 Katsui ..... 361/697
6,517,326 B2 * 2/2003 Fujinaka et al. ..... 417/354
6,519,149 B1 * 2/2003 Inoue ..... 361/689
6,520,250 B2 * 2/2003 Lee et al. ..... 165/121
6,525,938 B1 * 2/2003 Chen ..... 361/695
6,525,939 B2 * 2/2003 Liang et al. ..... 361/697
6,535,385 B2 * 3/2003 Lee ..... 361/697
6,535,386 B2 * 3/2003 Sathe et al. ..... 361/700
6,538,886 B2 * 3/2003 Yu ..... 361/695
6,540,479 B2 * 4/2003 Liao et al. ..... 415/199.5
6,541,733 B1 * 4/2003 Mannava et al. ..... 219/121.85
6,542,370 B1 * 4/2003 Wang et al. ..... 361/704

FOREIGN PATENT DOCUMENTS

JP 2002317789 A * 10/2002 ..... F04D/17/04

* cited by examiner

*Primary Examiner*—Nicholas Ponomarenko
*Assistant Examiner*—Pedro J. Cuevas
(74) *Attorney, Agent, or Firm*—Blakely, Sokoloff, Taylor & Zafman LLP

(57) ABSTRACT

A fan assembly is described having a circular arrangement of fins located around a circular arrangement of blades. Air leaving tips of the blades has high velocity to efficiently break down a convection barrier layer on each of the fins. By breaking down the convection barrier layer, more heat is transferred from the fins to the air. An additional set of blades is located around the fins and an additional set of fins is located around the additional set of blades. Each fin is attached to a respective turn of a coiled heat pipe. The heat pipe has an end which is thermally connected to a processor of a computer.

18 Claims, 2 Drawing Sheets

RADIAL AIR FLOW FAN ASSEMBLY HAVING STATOR FINS SURROUNDING ROTOR BLADES

BACKGROUND OF THE INVENTION

1). Field of the Invention

This invention relates to a fan assembly for a computer.

2). Discussion of Related Art

A computer usually includes a logic processor which, when operated, generates heat. Logic processors are becoming faster and are generating more heat. Logic processors require cooling in order to maintain functional dignity.

Components that are frequently used for cooling logic processors include fans and heat sinks. In one example, a spreader plate of a heat sink is attached to a logic processor and heat is conducted through the spreader plate to fins attached to the spreader plate. A fan is mounted over the fins and blows air over the fins. The air flows generally in a direction along an axis of rotation of blades of the fan and does not have high speed when leaving the blades. The fins are usually in the form of an extruded bank and are generally located in line.

Due to low velocity of the air when leaving the fan and other factors such as incompatibility of geometries of such a fan and a set if such fins, the air decelerates dramatically before flowing over the fins. Because of a low velocity of the air flowing over the fins, a limited amount of heat can be transferred.

Furthermore, such an arrangement does not optimize the number of fins in a given volume, which makes such an arrangement less suitable for locating within the small confines of a housing of a mobile computer such as a notebook computer.

BRIEF DESCRIPTION OF THE DRAWINGS

The invention is described by way of example with referenced to the accompanying drawings wherein.

DETAILED DESCRIPTION OF THE INVENTION

Figure 1:
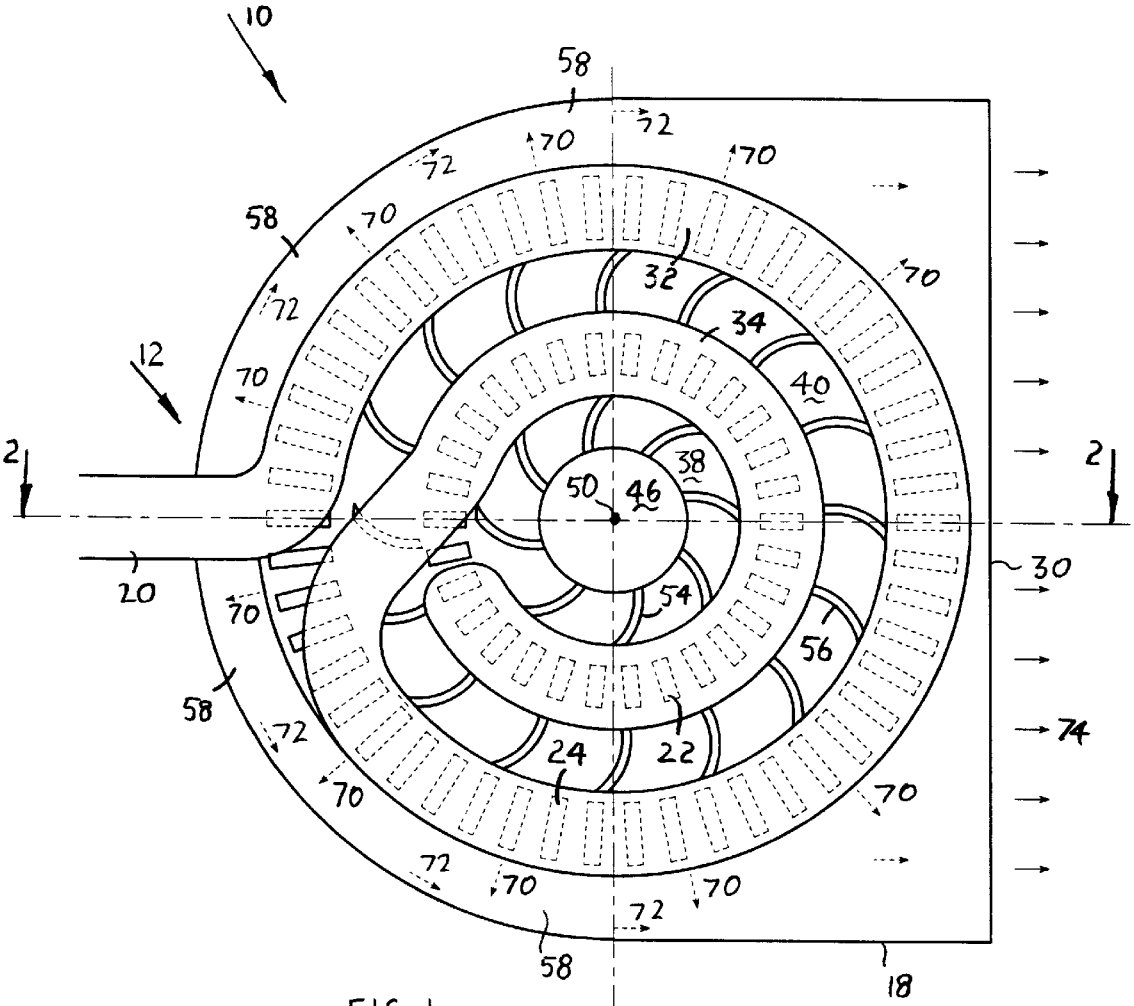
FIG. 1 is a top plan view of a fan assembly for a computer according to an embodiment of the invention.
Figure 2:
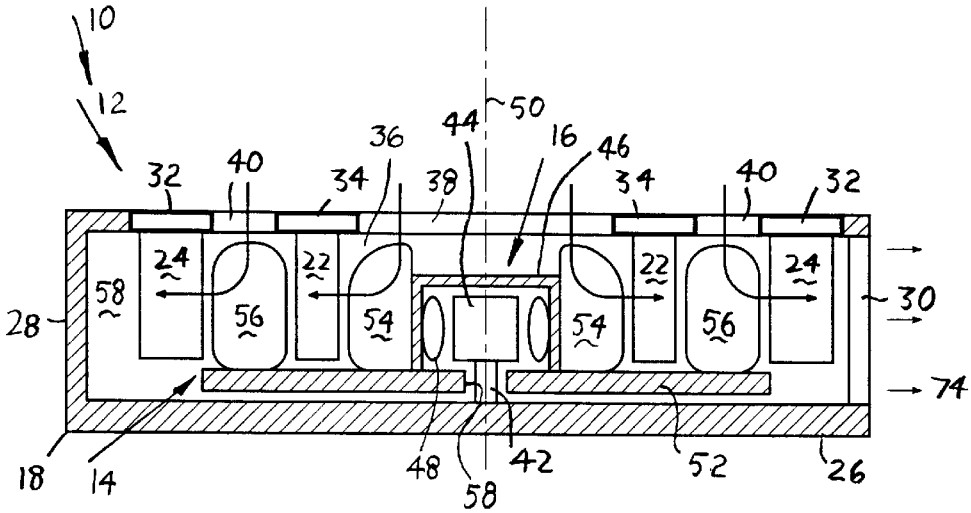
FIG. 2 is a cross-sectional side view on 2—2 in FIG. 1.

FIGS. 1 and 2 of the accompanying drawings illustrate a fan assembly 10 for a computer, according to an embodiment of the invention. The fan assembly 10 includes a stationary subassembly 12 and a rotating subassembly 14. An electric motor 16 includes some components forming part of the stationary subassembly 12 and some components forming part of the rotating subassembly 14.

The stationary subassembly 12 includes an injection-molded housing 18, a heat pipe 20, an inner set of fins 22, and an outer set of fins 24.

The fan housing 18 includes a base 26 and sidewalls 28. A lefthand portion of the base 26 has a circular periphery and a righthand portion of the base 26 has a rectangular periphery. The sidewalls 28 extend upwardly from peripheries of the base 26. No sidewall is formed on a long edge of the rectangular portion of the base 26 so as to form an exit port 30 above the long edge of the rectangular portion of the base 26.

The heat pipe 20 is a flat heat pipe which is formed into a spiral shape having outer and inner turns 32 and 34 respectively. The outer turn is larger than and located externally of the inner turn 34. An outer edge of the outer turn 32 of the heat pipe 20 is secured to upper edges of the sidewalls 28. The housing 18 and the heat pipe 20 form a stator component shroud defining an enclosure 36. An opening within the inner turn 34 forms a central inlet port 38 into the enclosure. A gap externally of the inner turn 34 and internally of the outer turn 32 forms an outer inlet port 40 into the enclosure 36. Air can enter the enclosure 36 through the inlet ports 38 and 40 and exit the enclosure 36 through the exit port 30.

The fins 22 and 24 are all mounted to the heat pipe 20 and extend from the heat pipe 20 downwardly into the enclosure 36. The inner fins 22 are all mounted to the inner turn 34 and the outer fins 24 are all mounted to the outer turn 32. The inner fins 22 form an inner circular arrangement. The outer fins 24 form an outer circular arrangement around the circular arrangement of the inner fins 22.

The electric motor 16 includes a shaft 42, a stator 44, a rotating housing 46, and windings 48. The shaft 42 is mounted to the base 26 and the stator 44 is mounted to the shaft 42. The shaft 42 and the stator 44 form part of the stationary subassembly 12 and are located within the enclosure 36. The stator 44 has a plurality of salient magnets (not shown) thereon. The windings 48 are secured directly to the rotating housing 46. The rotating housing 46 is located over the stator 44 with the windings 48 located adjacent the salient magnets on the stator 44. The rotating housing 46 is mounted to the shaft 42 through a bearing (not shown). The rotating housing 46 is rotatable about an axis 50 extending through the base 26, the shaft 42, the stator 44, and the central inlet port 38.

Alternating currents can be applied to the windings 48 to create magnetic fields within the rotating housing 46 and through the salient magnets of the stator 44. By selectively alternating the currents in the windings 48, rotation can be imparted onto the rotating housing 46. The windings 48 rotate together with the rotating housing 36 about the axis 50. The rotating housing 46 and the windings 48 thus form part of the rotating subassembly 14.

The rotating subassembly 14 further includes a disk-shaped rotor component 52, an inner set of fan blades 54, and an outer set of fan blades 56. The rotor component 52 has a central opening 58 located over the shaft 42. The rotor component 52 is mounted to the rotating housing 46 as to be rotatable together with the rotating housing about the axis 50.

The blades 54 and 56 are mounted to the stator component 52 and extend upwardly therefrom. The inner blades 54 are located in an inner circular arrangement adjacent the rotating housing 46, below the central inlet port 38. The inner fins 22 are located around the blades 54. The outer blades 56 are located in a circular arrangement in a gap around the inner fins 22 and within the outer fins 24 and below the outer inlet port 40. The outer fins 24, are located around the outer blades 56. A volute 58 is defined between the outer fins 24 and the sidewalls 28.

Figure 3:
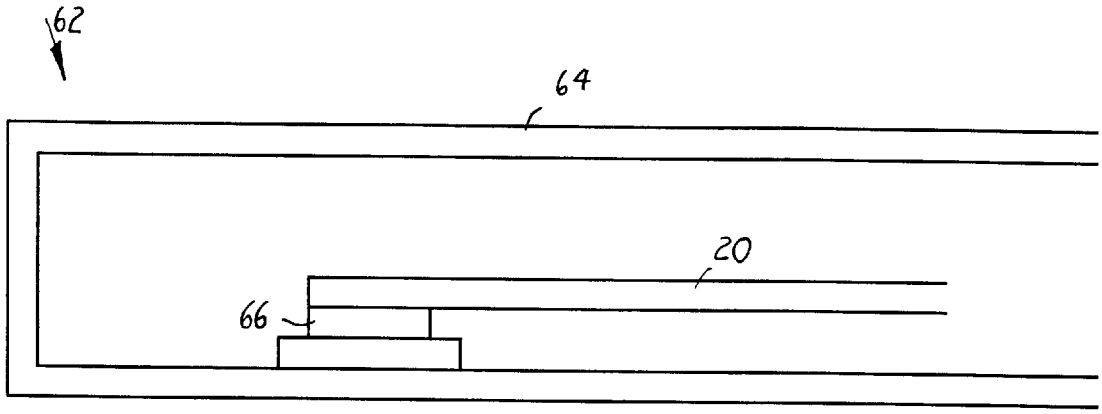
FIG. 3 is a cross-sectional side view of a computer having a logic processor connected to a heat pipe of the fan assembly.

FIG. 3 illustrates a computer 62 including a computer housing 64 and a logic processor 66. The logic processor 66 is mounted within the computer housing 64. The computer 62 further includes the fan assembly 10 of FIGS. 1 and 2. The fan assembly 10 is mounted within the computer housing 64. An end of the heat pipe 20 located distant from the fan housing 18 of the fan assembly 10 is located adjacent the processor 66. An end of the heat pipe 20 is thermally connected to the processor 66.

In use, electronic signals are transmitted to and from the processor 66. Operation of the processor 66 causes heat to be generated by the processor 66. The heat is conducted to a liquid on a wicking layer on an inner surface of the heat pipe 20. The liquid is heated and evaporates from the wicking layer. A vapor so created flows down the heat pipe 20 to the fan assembly 10 and into the turns 32 and 34. Heat is transferred from the vapor through a wall of the heat pipe 20 to the fins 22 and 24.

The rotating subassembly 14 is rotated by alternating the currents and the windings 48. The blades 54 and 56 are inclined so that they draw air in through the inlet ports 38 and 40 upon rotation. The blades 54 draw air into the central inlet port 38 and the blades 56 draw air into the outer inlet port 40.

The blades 54 expel the air in a radial direction away from the axis 50. The air flows from the blades 54 over the fins 22. The air has high velocity when leaving tips of the blades 54 and when subsequently flowing over the fins 22. Because of the high velocity, a convection barrier layer on a fin 22 is broken down. Heat can then more effectively be transferred from the fin 22 to the air flowing over the fin 22 when the convection barrier layer is broken down.

The air flowing over the fins 22 then flows over the blades 56. The air from the fins 22 is mixed with air that is drawn in by the blades 56 through the outer inlet port 40. The mixture of air is then expelled by the blades 56 over the fins 24 in a radial direction away from the axis 50. Again, because of high velocity of the air when leaving the blades 56 and when subsequently flowing over the fins 24, a barrier layer over a fin 24 is more effectively broken down resulting in more efficient transfer of heat from the blade 24 to the air flowing over the blade 24.

The air flows in radial directions 70 off the fins 24. Some of the air flowing in the radial directions 70 flows into the volute 58 where the air is collected. The air flows in the volute 58 in tangential directions 72 to the exit port 30. All the air leaves the enclosure 38 through the exit port 30. The air leaving through the exit port 30 flows in a direction 74 away from the axis 50 and substantially in a plane of the blades 54 and 56 and the fins 22 and 24 as seen in FIG. 2.

It can thus be seen that the fan assembly 10 provides for efficient cooling of the processor 66. The high velocities of the air from tips of the blades 54 and 56 are used to more efficiently cool the fins 22 and 24. The fins 22 and 24 are located in concentric circular arrangement close to tips of the blades 54 and 56 to ensure that air with high velocity flows over the fins 22 and 24. A larger number of fins can also be positioned in such concentric circular arrangements than would be the case when, for example, utilizing an extruded bank of fins on one side of the fan assembly 10, which makes the assembly 10 suitable for locating within the small confines of a mobile computer such as a notebook computer.

Other assemblies may prove suitable for purposes of cooling processors. One assembly may for example utilize only a single circular arrangement of blades and a single circular arrangement of fins. Another assembly may for example utilize a semicircular arrangement of fins surrounding a circular arrangements of fins. The semicircular arrangement of fins would in such an embodiment typically be located near an exit port. It may also be possible that a fan assembly may include a blank of extruded fins located in a row.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed is:

1. A fan assembly for a computer, comprising:

a stator component;

a rotor component mounted to the stator component for rotation about an axis;

a first set of blades mounted to the rotor component, the blades expelling air therefrom in a radial direction away from the axis upon rotation of the rotor component;

a first set of fins mounted to the stator component in an arrangement at least partially surrounding the first set of blades; and a second set of blades mounted to the rotor component around the first set of fins, air leaving the first set of blades passing over the first set of fins, whereafter the air is expelled by the second set of blades.

2. The fan assembly of claim 1 wherein the arrangement of the first set of fins is substantially circular.

3. The fan assembly of claim 2 wherein the fins of the first set of fins entirely surround the first set of blades.

4. The fan assembly of claim 1 wherein the fins of the first set of fins entirely surround the first set of blades.

5. The fan assembly of claim 1 further comprising:

a second set of fins mounted to the stator component, the air being expelled by the second set of blades passing over the second set of fins.

6. The fan assembly of claim 5 wherein the second set of fins are in an arrangement at least partially surrounding the second set of blades.

7. The fan assembly of claim 6 wherein the arrangement of the second set of fins is substantially circular.

8. The fan assembly of claim 1 wherein the stator component includes a heat pipe.

9. The fan assembly of claim 8 wherein the heat pipe includes a length located adjacent subsequent ones of the fins of the first set of fins.

10. The fan assembly of claim 9 wherein the fins of the first set of fins are mounted to the length of the heat pipe.

11. The fan assembly of claim 1 wherein the stator component is a shroud forming an enclosure with the blades and the fins in the enclosure, the shroud having an inlet port to allow air into the enclosure and an exit port allowing air out of the enclosure.

12. The fan assembly of claim 11 wherein the inlet port allows air into the enclosure substantially in direction of the axis and the exit port allows air out of the enclosure substantially in a direction away from the axis.

13. The fan assembly of claim 12 wherein at least 90% of air from the enclosure is expelled to one side of the shroud out of the exit port.

14. The fan assembly of claim 12 wherein at least some of the fins of the first set of fins are located between at least some of the blades of the first set of blades and the exit port.

15. The fan assembly of claim 11 wherein the shroud includes a heat pipe.

16. A fan assembly for a computer, comprising:

a stationary subassembly including a stator component and first and second sets of fins mounted to the stator component each set of fins forming at least a partial circular arrangement with the first set of fins located within the circular arrangement of the second set of fins; and a rotating subassembly including a rotor component rotatably mounted to the stator component and first and second sets of blades mounted to the rotor component so as to be rotatable together with the rotor component, each set of blades forming a circular arrangement with the first set of blades located within the circular arrangement of the first set of fins and the second set of blades located within a circular gap defined outerly of the circular arrangement of the first set of fins and internally of the circular arrangement of the second set of fins.

17. The fan assembly of claim 16 wherein the stator component includes a heat pipe.

18. The fan assembly of claim 16 wherein the stator component is a shroud forming an enclosure with the blades and the fins in the enclosure, the shroud having an inlet port to allow air into the enclosure and an exit port allowing air out of the enclosure.

* * * * *